US006195059B1

(12) United States Patent
Falk

(10) Patent No.: US 6,195,059 B1
(45) Date of Patent: Feb. 27, 2001

(54) SCANNING LENS ANTENNA

(75) Inventor: Kent Olof Falk, Mölnlycke (SE)

(73) Assignee: Telefonaktiebolaget L M Ericsson, Stockholm (SE)

( * ) Notice: Subject to any disclaimer, the term of this patent is extended or adjusted under 35 U.S.C. 154(b) by 0 days.

(21) Appl. No.: 09/454,224

(22) Filed: Dec. 2, 1999

(30) Foreign Application Priority Data

Dec. 3, 1998 (SE) ..... 9804197
Feb. 2, 1999 (SE) ..... 9900336

(51) Int. Cl.[7] ..... H01Q 19/06
(52) U.S. Cl. ..... 343/754; 343/909; 343/787
(58) Field of Search ..... 343/753, 754, 343/755, 756, 757, 785, 787, 909

(56) References Cited

U.S. PATENT DOCUMENTS

| | | | | |
|---|---|---|---|---|
| 4,636,799 | | 1/1987 | Kubick | 343/754 |
| 4,706,094 | | 11/1987 | Kubick | 343/754 |
| 5,309,166 | * | 5/1994 | Collier et al. | 343/754 |
| 5,729,239 | * | 3/1998 | Rao | 343/753 |

FOREIGN PATENT DOCUMENTS

WO93/1057 5/1993 (WO) .

OTHER PUBLICATIONS

Romedahl, B.; International–Type Search Report, Sep. 22, 1999, Search Request No. SE99/00121, pp. 1–3.

* cited by examiner

*Primary Examiner*—Tan Ho
(74) *Attorney, Agent, or Firm*—Jenkens & Gilchrist, a Professional Corporation

(57) ABSTRACT

A method and a device is disclosed for the generation of a lens device including a plate of ferroelectric material, the transmission phase gradient of which is be varied over the lens by means of a controllable static electric field. The lens may involve an entire antenna aperture, e.g. a feeder horn or constitute a body covering a slotted wave-guide antenna, be a portion of an antenna aperture or an element in a conventional array aperture. The division of the aperture depends on the number of degrees of freedom to be controlled simultaneously. In a general case N lobes and M nulls are to be controlled at the same time. In the most simple case with N=1 and M=0 the lens should be the entire antenna aperture. The invention is based on the fact that the direction of the wires of the control grids (1, 2) in the lens device must run perpendicular to the direction of the E-field direction of a penetrating high frequency radio wave. To obtain a full steering capability of an antenna lobe both in the X-Z plane and the Y-Z plane static electric fields are created by means of voltage sources (26, 36) along the wires of one grid or across the wires of the other grid of the continuous scanning lens.

8 Claims, 3 Drawing Sheets

SCANNING LENS ANTENNA

TECHNICAL FIELD

The present invention relates to a continuous scanning lens antenna device, and more exactly to a method and a device providing control of the direction of a main lobe or lobes of a scanning antenna without mechanically moving the antenna.

BACKGROUND

Sometimes it is desirable to be able to quickly change radiation direction of an antenna. In other words the antenna lobe is to be quickly shifted or swept between different directions. The demand regarding time is often such that an arrangement for mechanical motions of the antenna is not feasible.

Today antenna arrays are used which contain elements in which a signal phase at each element may be individually set to achieve a control of the main direction of the antenna lobe. Another technique to achieve a control of a radiation lobe is to utilize what is normally referred to as an "optical phased array", which includes an adaptable lens which, for instance, is disclosed in a document U.S. Pat. No. 5,212,583. This document describes a device utilizing a single plate of a material presenting ferroelectric properties. In a second embodiment disclosed the ferroelectric plate is provided with a ground-plane on one side and two orthogonal grids on the other side for radiation lobe control. Both the grids and the ground-plane are made in a light transparent material, indium/tin oxide. This document only refers to optical systems and does not discuss whether this is applicable to the microwave range.

However, in a microwave system, when the wavelength of an electromagnetic wave generally is much larger than the distance between conducting grid wires, it should be noted that only a grid wire direction being perpendicular to the E-field vector of the propagating wave can be utilized for controlling the refractive index of the ferroelectric plate. A grid wire direction parallel to the E field vector will result in a reflection of the electromagnetic wave. In the disclosed optical system the grid conductor wire distances are expected to be much larger than the wavelength of the light, i.e. $\lambda \ll$wire separation. Besides a conducting ground-plane will totally reflect the propagating microwave.

Two documents U.S. Pat. Nos. 4,706,094 and 4,636,799 both disclose a ferroelectric block between grids of parallel wires. According to the first document only controlling fields are used across the block, i.e. in the propagation direction of the wave. According to the other document the voltages at the wires are arranged such that the field may adopt arbitrary directions in the plane perpendicular to the wires. In the first document it is pointed out that the "normally" high conductive wires only transmits perpendicular, linear polarization but that they may be replaced by resistive wires being able to transmit also parallel polarization at some loss.

WO,A1,93/10571 demonstrates a development of U.S. Pat. No. 4,636,799 where only fields perpendicular to the wires are used. Here only one layer of wires is needed and the ferroelectric material has been divided into a plurality of blocks such that the grid of wires can be disposed in the middle of the ferroelectric layer.

However it will be noted that, the documents cited above are addressing the use of highly conductive wires and a voltage gradient is then achieved by applying different voltages to the individual wires according to a given pattern. Furthermore the devices described are related to utilizing the ferroelectric material for "electro-optic lenses" which primarily directs the utilization to frequencies corresponding to electromagnetic radiation in the nanometer range.

Furthermore none of the documents has disclosed a device being able to scan microwave radiation in two orthogonal planes in a single ferroelectric plate. Neither it has been shown that this can be done by using several layers of ferroelectric material without losses.

Therefore there is still a demand for a method and a device, which will operate even at a much lower frequency range, i.e., in the microwave range.

SUMMARY

The present invention discloses a method and a device for the generation of a lens device including a plate of ferroelectric material, the transmission phase gradient of which is varied over the surface of the lens by means of controllable static electric fields. The lens may involve an entire antenna aperture, e.g. a feeder horn or constitute a surface covering a slotted waveguide antenna, be a portion of a microwave antenna aperture or an element in a conventional microwave array aperture. The division of the aperture depends on the number of degrees of freedom to be controlled simultaneously. In a general case N lobes and M nulls are to be controlled at the same time. In the most simple case with N=1 and M=0 the lens will cover the entire antenna aperture.

The present invention is based on the fact that the direction of the wires of the control grids for the lens device must run perpendicular to the direction of the E-field direction of a penetrating high frequency radio wave. According to an object of the present invention to obtain a full steering capability of an antenna lobe both in the X-Z plane and the Y-Z plane static electric fields are created by means of two voltage sources producing one field acting along the wires of one grid and another field acting across the wires of the other grid of the continuous scanning lens. In order to obtain low losses and no change of the controlling E field polarity when sweeping the voltage sources, a bias source of the order several hundreds of volts is applied between the two voltage sources.

A method according to the present invention is set forth by the attached independent claim 1 and by the dependent claims 2 to 4.

Similarly a continuous scanning lens antenna device according to the method of the present invention is set forth by the attached independent claim 5 and further embodiments are defined in the dependent claims 6 to 8.

BRIEF DESCRIPTION OF THE DRAWINGS

The invention, together with further objects and advantages thereof, may best be understood by making reference to the following description taken together with the accompanying drawings, in which.

DETAILED DESCRIPTION

Example of Embodiments

In a material presenting ferroelectric properties the dielectric properties will change under the influence of an electric field. This will be further discussed below in connection to a description of lobe control. Such a change of the dielectric properties of a ferroelectric plate will be utilized for creating a controllable continuous scanning lens antenna. The antenna aperture or a portion of an aperture may be built up by means of a lens element having highly conductive galvanically isolated parallel metal wires (in an Y direction). By coating the wires with a material presenting ferroelectric properties a phase gradient will be achieved across the plate if an electric field having a suitable gradient is applied over the plate presenting the ferroelectric properties.

The arrangement relies on the fact that the direction of the wires of the control grid in the lens device must run perpendicular to the direction of the E-field direction of a penetrating high frequency radio wave. According to the present invention to obtain full steering of the antenna lobe static electric fields are to be created both along the wires of one grid and across the wires of the other grid for forming a continuous scanning lens for an antenna arrangement.

Figure 1:
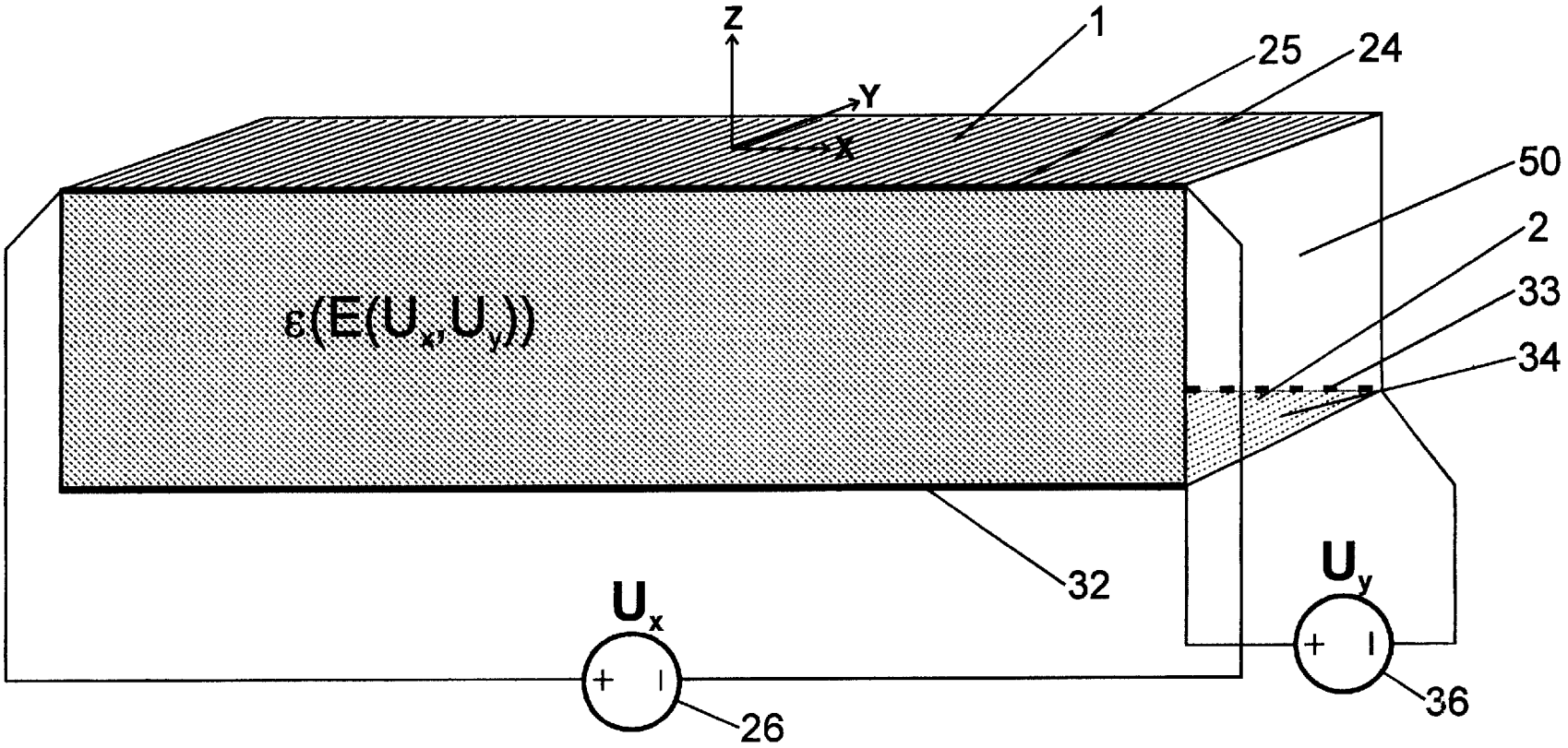
FIG. 1 is a sketch which illustrates the principle according to the present invention.

The static electric fields in the X and Y directions will be achieved by means of two separate layers of parallel wires. The wires of the first and second layer in the arrangement are parallel to each other, also see FIG. 1. One layer 1 of highly conducting wires 24 is positioned at a first side of the plate 50 made of a material presenting the ferroelectric properties. The wires 24 then form the first grid 1. Another layer of resistive wires 34 is positioned at the second side of the plate material then forming the second grid 2. For instance, the lower surface of the plate is to be illuminated with a linearly polarized field, propagating along the Z-axis. The E-field vector of the propagating wave is arranged to be perpendicular to the wires 24 and 34 (Ey=Ez=0). In other word the wires 24 and 34 run in an Y direction according to FIG. 1.

The ends of the highly conducting wires 24 at the upper side of the lens 50 are all successively electrically connected at intervals along a resistive wire 25, while the other ends of the highly conducting wires 24 remain unconnected. A variable voltage source (Ux) 26 is connected across the resistive wire 25 which is connected to the wires 24 and the voltage potential gradient across the resistive wire 25 will be distributed over the entire first grid 1 by means of the wires 24.

Figure 2:
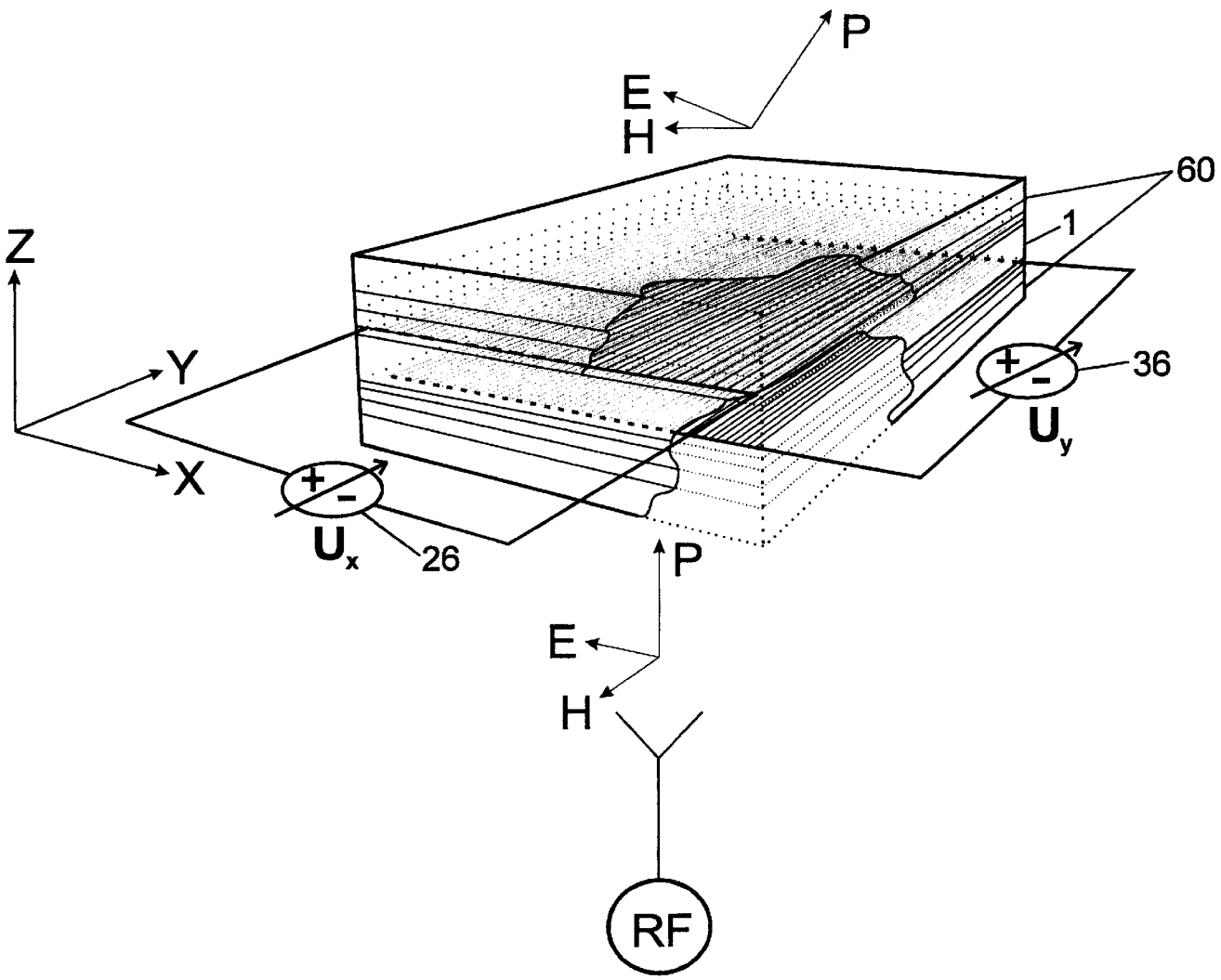
FIG. 2 illustrates an embodiment of a scanning lens element according to the principle shown in FIG. 1.

The ends of the resistive wires 34 of the grid 2 at the lower side of the plate 50 are connected in parallel by means of one metallic wire 32 at one end and another metallic wire 33 at the other end of the wires 34. A second variable voltage source (Uy) 36 is connected to the wires 32 and 33, and consequently across the second grid 2 of parallel resistive wires 34. Due to the voltage applied across the resistive wires 34 an electric potential gradient will then be created in the Y direction. Now, as is indicated in FIG. 2, the lobe of the antenna having the continuous scanning lens can by means of Ux be controlled in the X-Z plane and by Uy in the Y-Z plane. In FIG. 2E represents the electric field vector and H the magnetic field vector of the propagating wave from the RF source. P represents the propagation vector (or Poynting vector).

Figure 3:
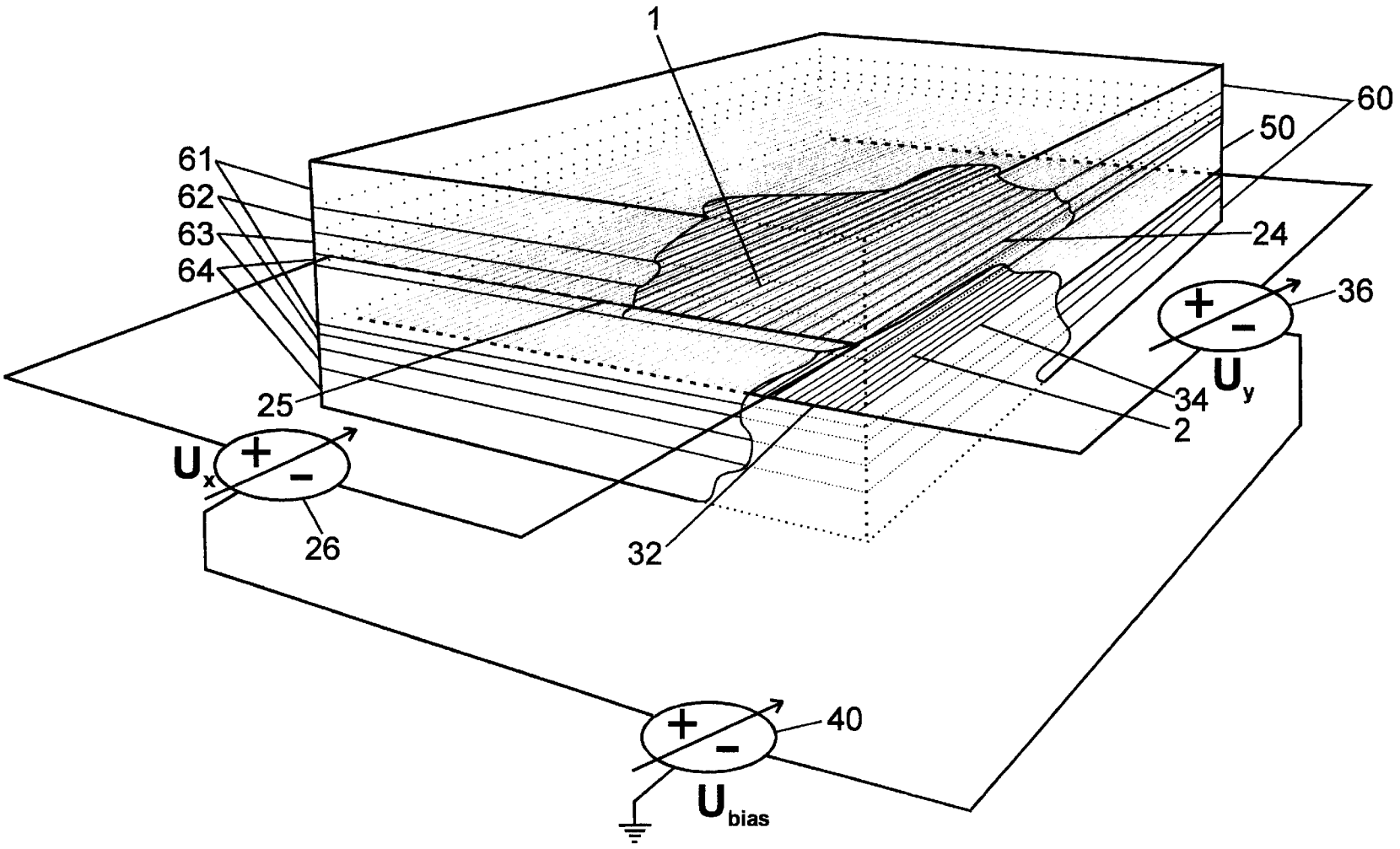
FIG. 3 is a more detailed view of the embodiment of the scanning illustrated in FIG. 2.

Further, similarly to FIG. 2, FIG. 3 demonstrates the structure of the continuous scanning lens, which will control an antenna lobe in the X-Z plane by means of the voltage Ux and in the Y-Z plane by means of the voltage Uy. In order to obtain low losses and no change of E field polarity when sweeping the voltages Ux and Uy, a bias source 40 (Ubias) of the order 5 to 10 kV is applied between the two voltage sources 26 and 36 for the X and Y direction, respectively. The symbols shown simply indicate that the bias is connected within the voltage range of the variable sources, preferably at a center point. In a similar manner it is indicated by the grounding at the symbol of the bias source how the device of the illustrative embodiment is referenced to a system ground.

To achieve an impedance matching to the surroundings, it will in most of the cases be necessary to cover the surface of the lens element on one side or on both sides with a transformer 60. This transformer changes, step by step or continuously, the impedance level such that the reflections, when the propagating wave enters or leaves the ferroelectric plate 50, become low enough within the operative frequency range. It is also possible to have the step by step or continuous change of impedance even entering into the ferroelectric material.

FIG. 3 demonstrates a more detailed embodiment of a scanning lens element according to the present invention. A typical desired frequency range for an antenna including the lens element according to the present invention may be of the order 30–40 GHz. In the illustrative embodiment the lens element includes a flat slice 50 of the material presenting the ferroelectric properties.

In this embodiment the material presenting the ferroelectric properties may be in the form of a flat square slice 50 having measures of about 10×10 cm and a thickness of about 0.5 cm. For instance, typical such materials are barium titanate, barium strontium titanate or lead titanate in fine grained random polycrystalline or ceramic form. A suitable ceramic, for instance made available on the market by Paratek Inc., Aberdeen, Md., U.S.A., is a material identified as Composition 4, which presents a relative dielectric constant $\in r$ (EDC=0)=118 and with a tunability of 10% according to the specification. This lens plate may for instance be positioned in connection to a feeder horn, cover a slotted wave-guide antenna, or as an element in a conventional array aperture Furthermore, on the top and/or the bottom of the slice 50 of the lens element there can be arranged an impedance transformer 60 to obtain an impedance matching for the present lens element, which may represent an impedance value of the order of 40 ohms. In the embodiment illustrated in FIG. 3 there is an impedance transformer onto each side of the lens element. In this illustrative embodiment both consist of a number of layers 61, 62, 63 and 64 of dielectric material presenting a stepwise change of the dielectric constant for a stepwise matching of the impedance of the lens element to the surroundings (e.g. free air≈377 ohms). If the lens element for instance is combined with a slot antenna there may be a need for only one transformer at the side facing air.

Description of Lobe Control

If Ux=Uy=0 the antenna lobe will coincide with the surface normal surface of the flat lens element being illuminated by an incident field perpendicular to the flat lens element. When for instance Ux and Uy are changed to Uxo and Uyo, respectively, it will be created a static electric field E over the material presenting the ferroelectric properties in accordance to:

$$E(x,y)=(U_{xo}\cdot x/x_a-U_{yo}\cdot y/y_a+U_{bias})/d \quad (1)$$

d is the thickness of the material presenting the ferroelectric properties, ya the extension of the plate in the Y direction of the aperture and xa its extension in the X direction $$\in(x,y)\cong\in(U_{bias})-C\cdot E(x,y) \quad (2)$$

If the dielectric constant $\in$ lies within a range being approximately linear as a function of E, this will result in a phase gradient over the lens for the transmitted wave according to:

$$\Delta\phi(x,y)=(2\pi d/\lambda_o)\cdot\sqrt{\in(x,y)} \quad (3)$$

The lobe will approximately point to the direction of the surface normal of the phase gradient in the middle of the aperture (x=y=0). The angle $\Phi x$ between the axis Z and the projection of the lobe onto the plane X-Z will approximately become:

$$\Phi_x=a\ \tan(d/dx(\Delta\phi(x,y))|_{x=y=0}\cdot(\lambda_0/(2\pi))) \quad (4)$$

The symbol $\in o$ represents the dielectric constant of the surrounding medium (normally air). In an analogue way the angle $\Phi y$ between the axis Z and the projection of the lobe onto the plane X-Y becomes approximately:

$$\Phi_y=a\ \tan(d/dy(\Delta\phi(x,y))|_{x=y=0}\cdot(\lambda_1/2\pi))) \quad (5)$$

Consequently a full lobe control will simply be obtained in both of the planes X-Z and Y-Z. A change of lobe direction is instantaneously obtained with a change of the applied electric voltages feeding the respective grids. The grids both have to be orthogonal to the E-field of the transmitted radio frequency wave, but the static field gradients across the respective grids will be perpendicular to each other due to the individual construction of the grids regarding the way the field gradients are created.

It will be understood by those skilled in the art that various modifications and changes may be made to the present invention without departure from the scope thereof, which is defined by the appended claims.

What is claimed is:

1. A method for obtaining a continuous scanning lens antenna comprising the steps of:

arranging a lens element in the form of a plate of a material presenting ferroelectric properties;

arranging a first grid of highly conducting wires onto a first side of the plate of material presenting ferroelectric properties, the highly conducting wires of the first grid being electrically connected at one end of the highly conductive wires at intervals along a resistive wire;

arranging a second grid of resistive wires onto a second side of the plate of material presenting ferroelectric properties, the wires of the second grid running parallel to the wires of the first grid and the wires of the second grid being connected in parallel by means a first and a second highly conducting wire, the resistive wires of the second grid being connected along the first and second highly conducting wires;

connecting a first variable voltage source across the resistive wire connected to the first grid of highly conductive wires forming a static potential gradient along the resistive wire, and connecting a second variable voltage source to the first and second highly conductive wires to create a static potential gradient along the resistive wires of the second grid, thereby forming perpendicular static E-fields across the plate;

illuminating one side of the plate of material presenting ferroelectric properties with a linearly polarized microwave field, the E vector of which being perpendicular to the direction of the wires of the first and second grids, controlling the dielectric constant across the surface of the lens element by controlling the voltages of the first and the second voltage sources to thereby control the direction of an antenna lobe generated by refracted microwave power by means of the scanning lens antenna.

2. The method according to claim 1, comprising the further step of arranging a biasing voltage between said first and second grids, or said first and second voltage sources, to obtain low loss operation and to guarantee no change of the static E-field polarity.

3. The method according to claim 1, comprising the further steps of arranging said first and second grids such that the wires are parallel and equidistant within each grid.

4. The method according to claim 1, comprising the further step of arranging an impedance matching to the surroundings by covering the at least one surface of the lens element with a transformation device, which, step by step or continuously, changes the impedance such that the coupling to the surroundings becomes sufficiently high within an operative frequency range of the antenna.

5. A continuous scanning lens antenna device comprising a lens element in the form of a plate of a material presenting ferroelectric properties;

a first grid of highly conducting wires onto a first side of the plate of material presenting ferroelectric properties, the highly conducting wires of the first grid being electrically connected at one end of the highly conductive wires at intervals along a resistive wire;

a second grid of resistive wires onto a second side of the plate of material presenting ferroelectric properties, the wires of the second grid running parallel to the wires of the first grid and the wires of the second grid being connected in parallel by means a first and a second highly conducting wire, the resistive wires of the second grid being connected along the first and second highly conducting wires; and a first variable voltage source is connected across the resistive wire connected to the first grid of highly conductive wires forming a static potential gradient along said resistive wire, and a second variable voltage source is connected to the first and second highly conductive wires to create a static potential gradient along the resistive wires of the second grid, thereby forming perpendicular static E-fields across the plate; and one side of the plate of material presenting ferroelectric properties being illuminated with a linearly polarized microwave field, the E vector of which being perpendicular to the direction of the wires of the first and second grid, whereby the dielectric constant across the surface of the lens element is controlled by means of the voltages of the first and the second voltage sources and then controlling the direction of an antenna lobe generated by refracted microwave power passing through the scanning lens antenna.

6. The device according to claim 5, wherein a biasing voltage is arranged between said first and second grids to obtain low loss operation and to guarantee no change of the static E-field polarity.

7. The device according to claim 5, wherein the wires of said first and second grid are arranged such that the respective wires are parallel and equidistant within each grid.

8. The device according to claim 5, comprising an impedance matching to the surroundings in the form of a transformation device covering at least one surface of the lens element, which transformation device, step by step or continuously, changes the impedance level such that the coupling to a surrounding medium becomes sufficiently high within the operative frequency range of the scanning lens antenna.

* * * * *